United States Patent [19]

Ausnit

[11] Patent Number: 4,970,845

[45] Date of Patent: Nov. 20, 1990

[54] METHOD FOR PREPARING AND FILLING CONTINUOUSLY LINKED TRAYS

[76] Inventor: Steven Ausnit, 124 E. 61st St., New York, N.Y. 10021

[21] Appl. No.: 362,059

[22] Filed: Jun. 6, 1989

[51] Int. Cl.[5] ..... B65B 7/26; B65B 7/28

[52] U.S. Cl. ..... 53/471; 53/473; 206/820; 414/788.2; 414/791.4; 414/795.6

[58] Field of Search ..... 53/282, 300, 316, 329, 53/376, 377, 382, 389, 467, 468, 473, 478, 484, 471; 206/820; 493/183, 902; 414/788.2, 791.4, 795.6

[56] References Cited

U.S. PATENT DOCUMENTS

| | | | |
|---|---|---|---|
| 2,842,920 | 7/1958 | Carkhuff et al. | 53/377 |
| 2,909,880 | 10/1959 | Mumma | 53/377 |
| 3,496,696 | 2/1970 | Wiley et al. | 53/467 |
| 3,512,332 | 5/1970 | Klein | 53/449 |
| 3,708,954 | 1/1973 | Wilke et al. | 53/329 |
| 3,877,205 | 4/1975 | Gundersen | 53/382 X |
| 4,030,272 | 6/1977 | Gundersen | 53/376 |
| 4,592,840 | 6/1986 | Brooks | 206/820 X |
| 4,624,099 | 11/1986 | Harder | 53/282 X |
| 4,704,844 | 11/1987 | Mancini | 54/468 X |

*Primary Examiner*—Robert L. Spruill
*Assistant Examiner*—Beth Bianca
*Attorney, Agent, or Firm*—Kane, Dalsimer, Sullivan, Kurucz, Levy, Eisele and Richard

[57] ABSTRACT

The present invention relates to a method and an apparatus for a tray arrangement for a series of continuously linked trays. The trays are adapted to be stacked by a twisting mechanism and by a series of curved side guards which twist and bend the links connecting the trays in order to arrange the trays into the proper configuration. The trays are then unstacked by another series of curved side guards and twisting mechanism and then each tray is in turn moved to a filling station where filling material is dispensed therein. The filled tray is then moved to a lid closing station where the attached flipped open lid of the tray is closed atop the tray. The tray is then pulled by a side grasping pull flange to a position where an overhead piston driven mechanism seals the lid and cuts the link, separating the tray from the nested of the trays.

12 Claims, 7 Drawing Sheets

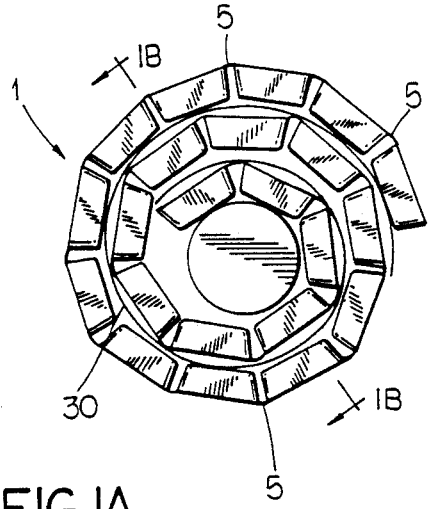
FIG. IA
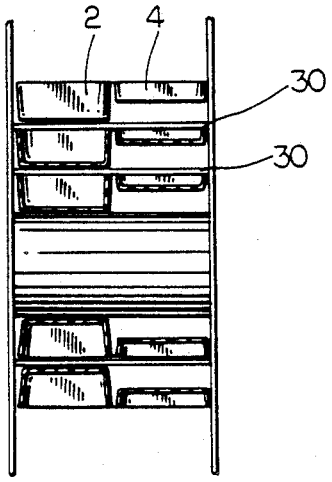
FIG. IB

METHOD FOR PREPARING AND FILLING CONTINUOUSLY LINKED TRAYS

BACKGROUND OF THE INVENTION

The present invention relates to a method and apparatus for forming continuously linked trays. In particular the present invention provides for a method and an apparatus for forming, moving, filling, sealing and separating continuously linked trays with form, fill, and seal machinery (FFS).

While FFS machinery is known in the art there is a problem associated with the use of such machinery on a set of continuously linked trays as these trays are normally stacked sequentially, right side up and such a stacking arrangement does not lend itself to handling by FFS machinery.

It is preferable to store a continuous chain of trays on either a spool 1 as shown in FIGS. 1A and 1B or by nesting trays as shown in FIG. 2A. If the trays are stored on a spool it would be necessary to provide a paper interlay 30 (See FIG. 1A) between layers of trays due to the increasing diameters of the trays as they are wound. This spool system will only work for small trays.

As shown in FIG. 2A the trays can also be stored in a nested arrangement. However in order to nest the continuously linked trays with one tray within the other it is necessary to have every other tray turned in opposing direction so that its bottom surface is turned upward as shown in FIG. 2B.

Thus it would be desirable to provide for an arrangement of trays which could be stored in such a manner as to be readied for FFS operation.

SUMMARY OF THE INVENTION

Accordingly, it is a principal object of the present invention to provide a method and apparatus for forming, filling and sealing a continuously linked set of trays which avoids the drawbacks of the aforementioned prior art proposals.

It is a further object to provide a tray arrangement wherein a series of continuously linked trays are stored in a predetermined arrangement and adapted to be moved out of said storage arrangement to a filling station, filled and sealed with a lid or a sheet of plastic and then the trays are separated from one another.

It is still another object of the present invention to provide a series of continuously linked trays wherein said trays are connected to each other by links that are adapted to be twisted 180 degrees and bent 180 degrees for stacking.

In order to implement these and other objects of the present invention, which will become more readily apparent as the description proceeds, the present invention provides for a tray arrangement for a series of continuously linked trays. The trays are adapted to be stacked by a twisting mechanism and a series of curved side guards which twist and bend the links connecting the trays in order to arrange the trays into the proper configuration. The trays are then unstacked by another series of side guards and twisting mechanism and then, each tray is in turn moved to a filling station where filling material is dispensed therein. The filled tray is then moved to a lid closing station where the attached flipped open lid of the tray is closed atop the tray. The tray is then pulled by a side grasping pull flange to a position where an overhead piston driven mechanism seals the lid and cuts the link, separating the tray from the rest of the trays.

Alternately, if the trays have no attached lids, a film approximately the width of the trays is drawn from a roll, across a tray at a sealing location and sealed onto the side edges of the tray. The film is then cut at the same time as the link attaching the trays to each other.

BRIEF DESCRIPTION OF THE DRAWINGS

For a fuller understanding of the nature and objects of the invention, reference should be had to the following detailed description taken in connection with the accompanying drawings, in which:

FIGS. 1A and 1B show side and front views of a spool stacking arrangement of trays;

DETAILED DESCRIPTION OF THE INVENTION

Figure 2A:
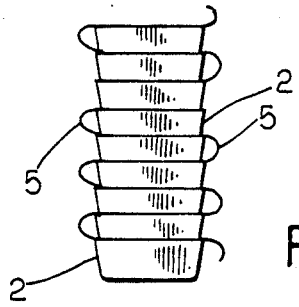
FIGS. 2A–2C illustrate a nesting stacking arrangement of trays.
Figure 2B:
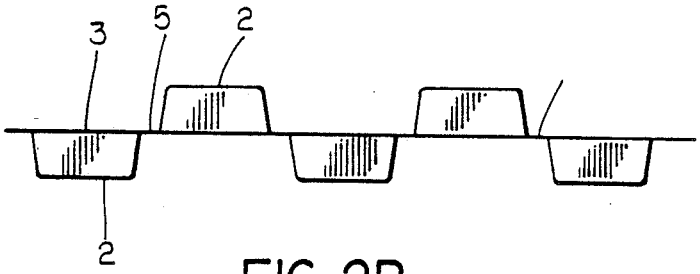
Figure 2C:
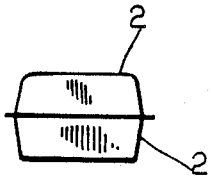
Figure 3A:
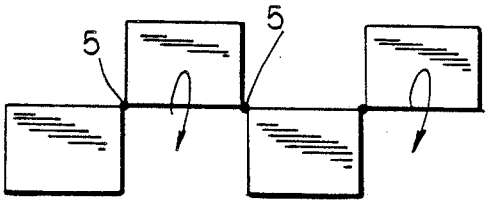
FIGS. 3A–3B show the top and side views of an arrangement of trays linked together by links adapted to be twisted 180° in accordance with the teachings of the present invention.
Figure 3B:
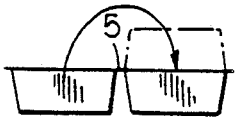
Figure 4A:
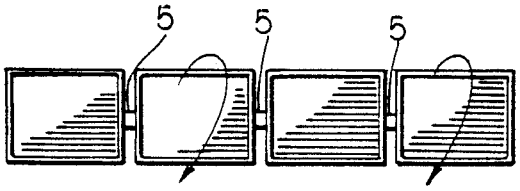
FIGS. 4A–4B show top and side views, respectively, of trays linked together prior to twisting the links 180 degrees in accordance with the teachings of the present invention.
Figure 4B:
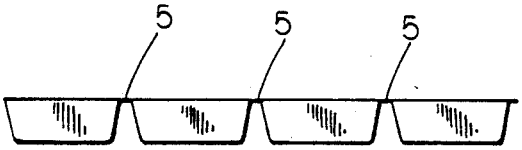
Figure 5A:
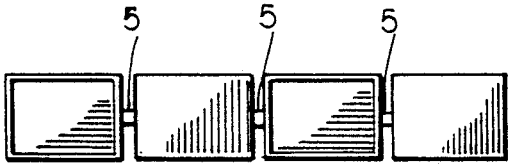
FIGS. 5A–5B show top and side views, respectively, of the trays of FIGS. 4A–4B after twisting the links 180 degrees in accordance with the teachings of the present invention.
Figure 5B:
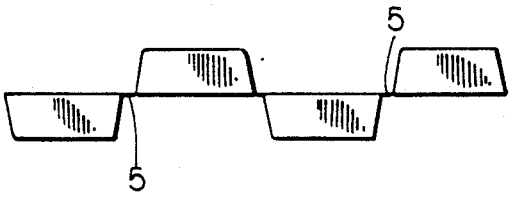
Figure 6A:
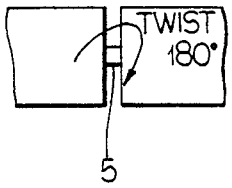
FIGS. 6A–6B show one of the links connecting the trays to each other adapted to be twisted 180 degrees (top view) and to be bent 180 degrees (side view) in accordance with the teachings of the present invention.
Figure 6B:
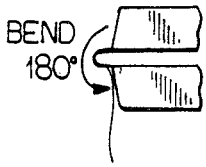
Figure 9A:
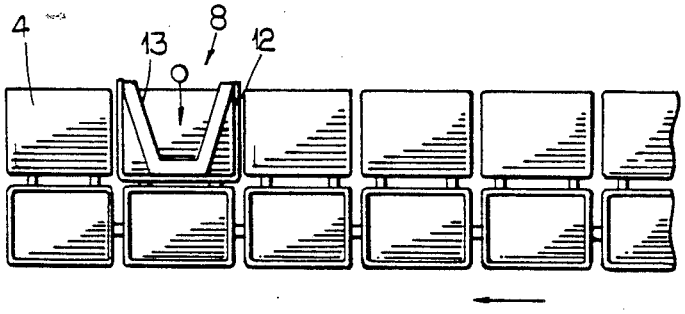
FIGS. 9A–9B shows top and side views of the trays being filled at the filling station in accordance with the teachings of the present invention.

Referring now to the drawings, a series of continuously linked trays 2 is shown in either FIG. 3 or FIG. 5. The trays 2 are open at their top surfaces 3 and have their attached lids 4 (FIG. 9A) flipped over at one of their sides. The trays 2 are connected to each other by links 5. The trays 2 may be linked together at their edges (FIG. 3) in which case the trays are arranged so that every other tray 2 is offset, or at their centers (FIGS. 4 and 5). In order to arrange the trays 2 for stacking each link 5 is twisted by a twisting mechanism, 180 degrees in a first direction and then bent 180 degrees in a second direction as shown in FIGS. 6A and 6B. When the link 5 is twisted 180 degree for stacking, every other tray 2 is upside down as shown for a center located link in FIG. 5A. The links 5 and the trays 2 are preferably integrally formed of polystyrene material.

Figure 7:
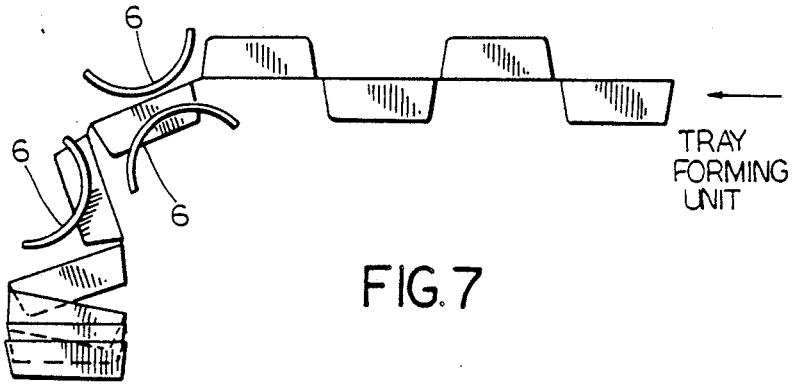
FIG. 7 shows the trays being arranged for stacking by curved side guards that bend the links in accordance with the teachings of the present invention.

After the trays have been twisted 180° so that every other tray is upside down, a series of curved side guides 6 facilitates the bending of the links for stacking purposes as shown in FIG. 7.

Figure 8:
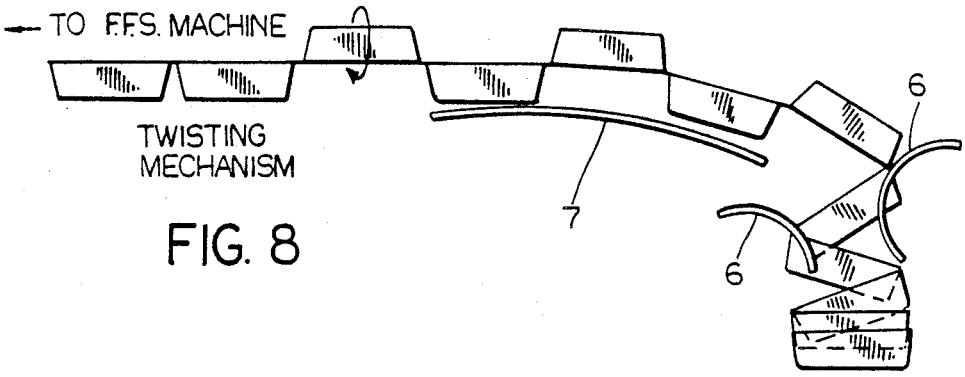
FIG. 8 shows the trays being unstacked by side guards and guided to the FFS machine in accordance with the teachings of the present invention.

As shown in FIG. 8 the trays are pulled out of their stacked arrangement by another series of curved side guards and bent back and twisted to their upright positions and conveyed along a bottom guide 7 to a filling station 8 of the FFS machine 9. Since the trays 2 are linked together it is a simple matter to pull them along a fixed track such as the bottom guide 7. In addition to the filling station 8, the FFS machine 9 includes a lid closing station 10 and a side grasping pull flange 11 which will be described more fully below.

Figure 9B:
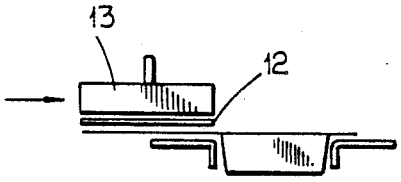
Figure 10A:
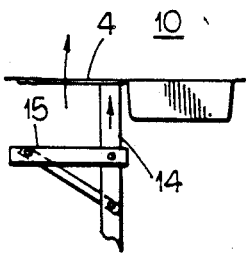
FIGS. 10A–10E shows, in five steps, a lid being applied to the top of a tray in accordance with the teachings of the present invention.
Figure 10B:
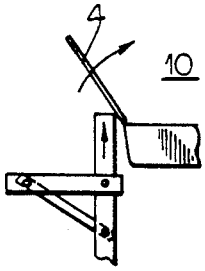
Figure 10C:
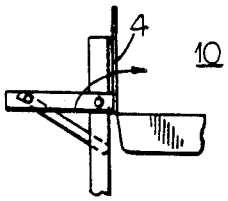
Figure 10D:
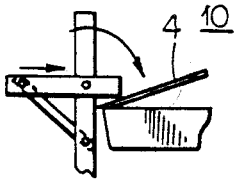
Figure 10E:
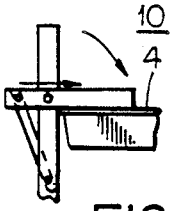
Figure 11A:
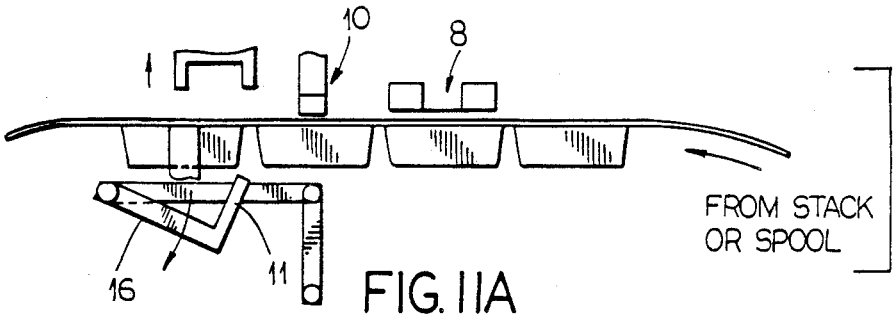
FIGS. 11A–11D shows, in four steps, the lid of each tray being pressed or sealed into position and each tray then being separated from the next tray in accordance with the teachings of the present invention.
Figure 11B:
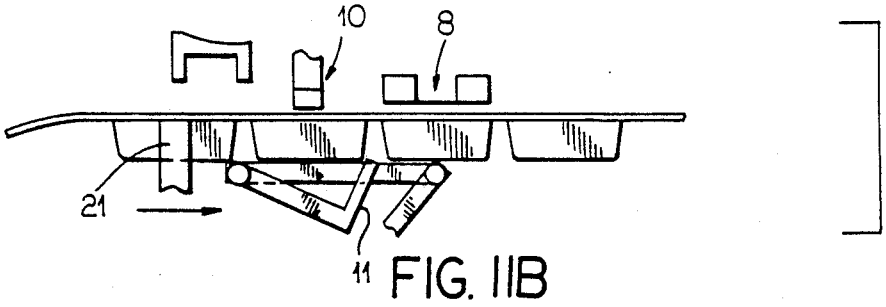
Figure 11C:
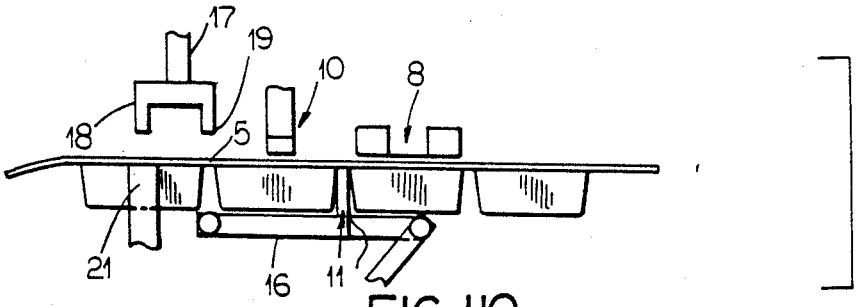
Figure 11D:
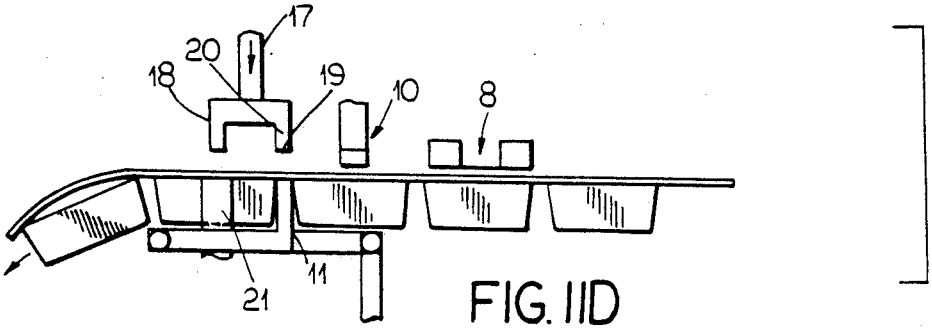

The filling station 8 includes a plate 12 which overlays the open tray lid and which has converging angled sides 13 that serve to funnel the filling material dispensed from the side into the to be filled tray 2, as shown in FIG. 9.

Next the thus filled tray 2 is moved to the lid closing station 10. The lid closing station 10 includes a vertical upwardly acting finger 14 and a horizontal acting finger 15 which is interconnected to and movable with respect to the vertical finger 14. The vertical finger 14 acts from below to lift the lid 4 of the tray 2 from a horizontal position to a vertical position as shown in FIG. 10, steps 1–3. The horizontal finger 15 then pushes against and causes the lid 4 to close atop the top surface of the tray 2 so that the lid 4 and the tray 2 are aligned for interlocking as shown in FIG. 10, steps 3–5. The lid 4 and the tray 2 have a mating detent and ring that form a snap button for interlocking and are thus aligned for interlocking at the lid locking station 20.

Figure 12:
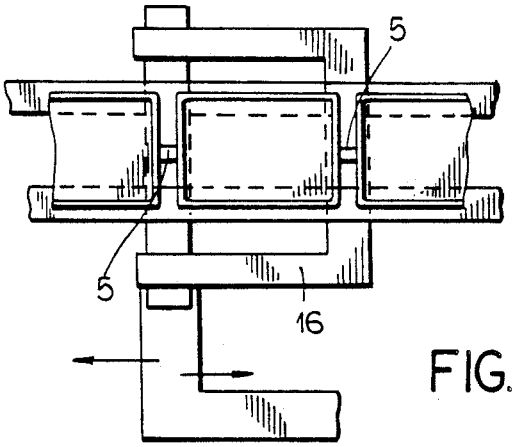
FIG. 12 shows a top view of the flange 11 and its driving mechanism.

A side-grasping pull flange 11, as shown in FIGS. 11 and 12, then grasps the side of the tray 2, pulling the tray 2 one length from the lid closing station 10 to the lid locking station 20 and thus at the same time pulling the tray behind tray 2 to the lid closing station 10 and the tray behind that tray to the filling station 8. The flange 11 is preferably L-shaped with the horizontal leg 16 acting as a base for the tray 2. A piston mechanism 17 is located above the tray 2, and is preferably U-shaped having two legs, the first of which is aligned directly over the snap button and is a pressure plate 18 which when pressed against support base 21, causes the snap button to interlock thus locking the tray lid 4 and the tray 2 together. The other leg of the piston mechanism has a knife 19 aligned directly above the link 5 connected to the tray 2 so that on a downward piston action the tray 2 is locked and the link 5 is cut at the same time, thus severing the tray 2 from the next tray 2. After the tray 2 is sealed and cut from the chain, it is displaced by the next oncoming tray 2 down into a chute.

The pulling flange 11 drops below the sealed and chain severed tray 2 and moves up and in between the junction of the next two adjoining trays 2, repeating the sealing and cutting operation for the next tray 2.

Figure 13A:
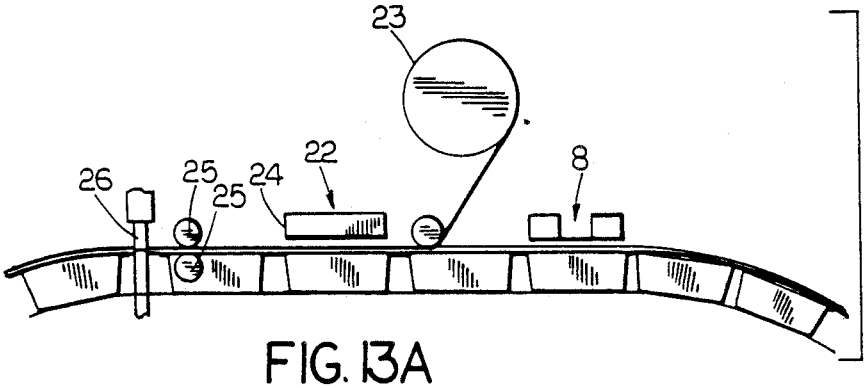
FIGS. 13A and 13B show an alternate embodiment of the present invention having a film sealing station instead of a lid closing station.
Figure 13B:
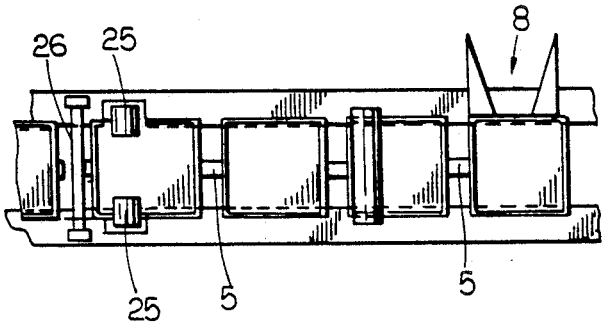

An alternate arrangement would provide linked trays as previously described, but with said trays having no lids. In this instance the machine is illustrated in FIG. 13. Following a similar filling station as in FIG. 11, the lid closing station is replaced by a film sealing station 22, that seals a film, brought from an overhead film roll 23, to the edges of the tray by a rectangular seal bar 24. In addition, the side grasping L-shaped flange of FIG. 11 is replaced by two sets of driving rollers 25, located at the edges of the tray chain, which grasp said edges of the tray positioned between them and move it toward one tray length to the next station, thereby moving each following tray into the next position, where a knife 26 separates the trays by cutting through the link and the film now sealed to the tray edges, thereby separating one tray from the other.

Obviously numerous operations may be made to the invention without departing from its scope as defined in the appended claims.

I claim:

1. A method of preparing a series of continuously linked trays, comprising:

moving a series of continuously linked trays to a filling station wherein said trays are initially formed in right side up pattern and connected by twistable, bendable links therebetween, twisting said links 180° in a first direction and bending said links 180° in a second direction with respect to said first direction so that said trays are stored in a predetermined order.

2. A method according to claim 1 wherein said predetermined order is a nesting arrangement of said trays.

3. A method according to claim 1 wherein said trays are formed of polystyrene material.

4. A method according to claim 1 wherein each said tray has a lid attached thereto.

5. A method according to claim 1 wherein said trays are moved out of storage from said predetermined order and said links are twisted 180° in a first direction and are bent 180° in a second direction with respect to said first direction so that said trays are sequentially arranged right side up before being moved to said filling station.

6. A method according to claim 5 further comprising moving each said tray subsequent to its being filled from said filling station to a lid closing station, said lid closing station including a vertical upward lifting finger and a horizontal finger interconnected to and movable with respect to said vertical finger said vertical finger lifting the lid of said tray from a horizontal to a vertical position, said horizontal finger acting on said lid in its vertical position to close and align said lid on said tray for sealing purposes.

7. A method according to claim 1 further comprising sealing a flexible sheet to the edges of each said tray after each said tray has been filled at said filling station.

8. A method according to claim 1 wherein said trays are arranged alternately offset from each other prior to being positioned alternately right side up and upside down.

9. A method of forming, filling and sealing a series of continuously linked trays comprising:

moving a series of continuously linked trays to a filling station, said trays being joined together by twistable links each said tray having an open top surface and a lid flipped open at one of its side;

twisting said links to orient each tray with its top surface directed upwardly;

filling each said tray at said filling station;

slipping said lid over said tray and thereby closing each said tray at its top surface with a lid; and separating each said tray form each other.

10. A method according to claim 9 said trays being arranged in a predetermined order that includes placing said trays on a spool with a paper interlay between tray layers.

11. A method according to claim 9 wherein said filling station includes a plate having angled sides disposed above said open surface of the tray to be filled and further comprising the step of funneling said filling material into said tray via said angled sides.

12. A method according to claim 11 further comprising:

closing each said tray with a lid at a lid closing station and moving said tray from said lid closing station by means of a side grasping pull flange which pulls said tray one length from the lid closing station, thus moving the next tray to the lid closing station and the tray behind the next tray to the filling station, said pull flange pulling said tray to a position underneath a piston mechanism having a pressure plate and a knife dispensed above a snap button of said tray and the link connected to said tray, respectively, said snap button being formed of a detent in said lid and a ring in said tray designed to interlock with one another upon the application of sufficient pressure so that upon a downward movement of said piston mechanism said pressure plate causes the snap button to interlock, sealing said lid and said tray, and said knife cuts said link separating said tray from the rest of the linked trays.

* * * * *